US008322253B2

(12) United States Patent
Howells

(10) Patent No.: US 8,322,253 B2
(45) Date of Patent: Dec. 4, 2012

(54) METHOD OF MANUFACTURING A UTILITY KNIFE BLADE HAVING AN INDUCTION HARDENED CUTTING EDGE

(75) Inventor: Hadyn Howells, Brimington (GB)

(73) Assignee: Stanley Black & Decker, Inc., New Britain, CT (US)

( * ) Notice: Subject to any disclaimer, the term of this patent is extended or adjusted under 35 U.S.C. 154(b) by 807 days.

(21) Appl. No.: 11/176,425

(22) Filed: Jul. 8, 2005

(65) Prior Publication Data

US 2007/0006683 A1 Jan. 11, 2007

(51) Int. Cl.
*B21K 11/00* (2006.01)
*B26B 21/54* (2006.01)
*C21D 9/18* (2006.01)

(52) U.S. Cl. ..... 76/104.1; 30/346.5; 30/350; 148/567

(58) Field of Classification Search ..... 76/104.1; 30/346.5, 346.61, 350; 148/152
See application file for complete search history.

(56) References Cited

U.S. PATENT DOCUMENTS

| | | | | | |
|---|---|---|---|---|---|
| 972,436 | A | | 10/1910 | Clark | |
| 1,130,650 | A | | 3/1915 | Whitaker | |
| 1,732,244 | A | * | 10/1929 | Salzman | 148/646 |
| 2,032,963 | A | * | 3/1936 | Voltmann | 148/287 |
| 2,073,502 | A | * | 3/1937 | Stargardter | 30/346.53 |
| 2,093,874 | A | | 9/1937 | Stargardter | |
| 2,131,505 | A | * | 9/1938 | Garsson | 148/633 |
| 3,411,208 | A | * | 11/1968 | Malm | 30/350 |
| 3,581,604 | A | * | 6/1971 | Malm | 76/101.1 |
| 3,608,877 | A | | 9/1971 | Dehn | |
| 3,923,561 | A | * | 12/1975 | Ishizawa et al. | 148/573 |
| 3,988,955 | A | * | 11/1976 | Engel et al. | 83/661 |
| 4,103,880 | A | * | 8/1978 | Westeren et al. | 266/253 |
| 4,383,677 | A | | 5/1983 | Kerr | |
| 4,534,827 | A | | 8/1985 | Henderson | |
| 4,693,157 | A | | 9/1987 | Looser | |
| 4,720,918 | A | * | 1/1988 | Curry et al. | 30/346.55 |
| 4,957,421 | A | * | 9/1990 | Baldi | 419/8 |
| 5,048,191 | A | | 9/1991 | Hahn | |
| 5,073,212 | A | * | 12/1991 | Frohlich | 148/566 |
| 5,077,901 | A | | 1/1992 | Warner et al. | |
| 5,295,305 | A | | 3/1994 | Hahn et al. | |
| 5,433,801 | A | * | 7/1995 | Althaus et al. | 148/578 |
| 5,458,025 | A | | 10/1995 | Neamtu | |

(Continued)

FOREIGN PATENT DOCUMENTS

FR 2 383 235 10/1978

(Continued)

OTHER PUBLICATIONS

United Kingdom Search Report issued for United Kingdom Patent Application No. GB0600251.3, dated Dec. 29, 2006.

(Continued)

*Primary Examiner* — Hwei-Siu C. Payer
(74) *Attorney, Agent, or Firm* — Pillsbury Winthrop Shaw Pittman LLP

(57) ABSTRACT

A method of manufacturing a blade including heating and quenching a coil of strip steel material to harden the material, heating the strip steel material to temper the material, grinding a first angle along an edge of the material, and subsequent to the grinding, re-hardening, for example by induction heating, the edge of the material.

30 Claims, 3 Drawing Sheets

U.S. PATENT DOCUMENTS

| | | | | |
|---|---|---|---|---|
| 5,609,075 | A | 3/1997 | Neamtu | |
| 5,987,752 | A * | 11/1999 | Swanstrom, Jr. | 30/186 |
| 6,293,020 | B1 | 9/2001 | Julien | |
| 6,335,506 | B2 * | 1/2002 | Christmas et al. | 219/121.66 |
| 6,389,699 | B1 * | 5/2002 | Ecer | 30/346.54 |
| 6,443,214 | B1 * | 9/2002 | Matsuo et al. | 164/126 |
| 6,632,301 | B2 | 10/2003 | Krauss et al. | |
| 6,632,302 | B2 | 10/2003 | Fisher et al. | |
| 6,701,627 | B2 * | 3/2004 | Korb et al. | 30/350 |
| 6,743,128 | B2 | 6/2004 | Liechty, II | |
| 6,813,923 | B2 * | 11/2004 | Jones et al. | 72/342.5 |
| 6,866,894 | B2 | 3/2005 | Trankiem et al. | |
| 6,903,316 | B2 * | 6/2005 | Kivisto | 219/635 |
| 6,957,598 | B2 * | 10/2005 | Neamtu et al. | 76/104.1 |
| 7,060,367 | B2 | 6/2006 | Yamada et al. | |
| 2002/0083598 | A1 * | 7/2002 | Julien | 30/350 |
| 2002/0100522 | A1 | 8/2002 | Benton et al. | |
| 2002/0142182 | A1 | 10/2002 | Peker et al. | |
| 2002/0151393 | A1 | 10/2002 | Liechty, II | |
| 2003/0019111 | A1 * | 1/2003 | Korb et al. | 30/351 |
| 2003/0019332 | A1 * | 1/2003 | Korb et al. | 76/104.1 |
| 2003/0213798 | A1 | 11/2003 | Saluja et al. | |
| 2004/0031787 | A1 | 2/2004 | Kivisto | |
| 2004/0113461 | A1 | 6/2004 | Shimizu et al. | |
| 2004/0168326 | A1 * | 9/2004 | Korb et al. | 30/350 |
| 2004/0169099 | A1 | 9/2004 | Tohkala | |
| 2004/0187644 | A1 | 9/2004 | Peterlin et al. | |
| 2004/0204726 | A1 * | 10/2004 | Miller et al. | 606/165 |
| 2004/0237722 | A1 | 12/2004 | Ponemayr | |
| 2004/0244539 | A1 * | 12/2004 | Korb et al. | 76/104.1 |
| 2012/0144680 | A1 * | 6/2012 | Scillia et al. | 30/350 |
| 2012/0205015 | A1 * | 8/2012 | Howells | 148/567 |

FOREIGN PATENT DOCUMENTS

| | | |
|---|---|---|
| GB | 645100 | 10/1950 |
| GB | 1050520 | 12/1966 |
| JP | 2003-147437 | 5/2003 |
| JP | 2003147437 A * | 5/2003 |

OTHER PUBLICATIONS

English Translation of First Office Action as issued for Chinese Patent Application No. 200610004434.4, dated May 8, 2009.

English Translation of Second Office Action as issued for Chinese Patent Application No. 200610004434.4, dated Jan. 8, 2010.

Combined Search and Examination Report as issued for Great Britain Divisional Patent Application No. 1019738.2, dated Dec. 10, 2010.

Notification of the Third Office Action as issued for Chinese Patent Application No. 200610004434.4, dated Dec. 24, 2010.

Examination Report as issued for Great Britain Patent Application No. 0600251.3, dated Apr. 1, 2011.

Examination Report as issued for Great Britain Patent Application No. 0600251.3, dated May 26, 2011.

Examination Report as issued for Great Britain Patent Application No. 0600251.3, dated Apr. 12, 2010.

Examination Report as issued for Great Britain Patent Application No. 0600251.3, dated Sep. 24, 2010.

* cited by examiner

METHOD OF MANUFACTURING A UTILITY KNIFE BLADE HAVING AN INDUCTION HARDENED CUTTING EDGE

BACKGROUND OF THE INVENTION

1. Field of the Invention

The present invention relates to a method of manufacturing a blade.

2. Description of Related Art

The manufacture of blades involves a sequence of manufacturing processes each of which is used to achieve a certain characteristic of the blade. In the manufacture of blades, it is common practice to employ a single strip of steel blade stock material from which a plurality of blades are produced. The strip of blade material may be provided in a coil form. The strip of blade stock is delivered to a punch press were a plurality of openings are stamped into the strip to define attach points employed to retain the blade in a cartridge or onto a knife/razor handle, to partially shape the blade and remove excess material and also to optionally stamp a brand name, logo or other indication thereon. The strip is then scored to form a plurality of axially spaced score lines, wherein each score line corresponds to a side edge of a respective blade and defines a breaking line for later snapping or cutting the scored strip into a plurality of blades. The strip of blade stock is then generally fed through a heat treating oven to harden and temper the strip material. The heat treated strip is conventionally ground, honed and/or stropped to form the facets defining a straight cutting edge along one side of the strip. The strip is subsequently snapped along the length of the strip at each score line to break the strip along the score lines to produce a plurality of blades.

BRIEF SUMMARY OF THE INVENTION

An aspect of the present invention is to provide a method of manufacturing a blade. The method includes heating and quenching a coil of strip steel material to harden the material, heating the strip steel material to temper the material, grinding a first angle along an edge of the material, and subsequent to the grinding, re-hardening the edge of the material.

DETAILED DESCRIPTION OF THE INVENTION

Figure 1:
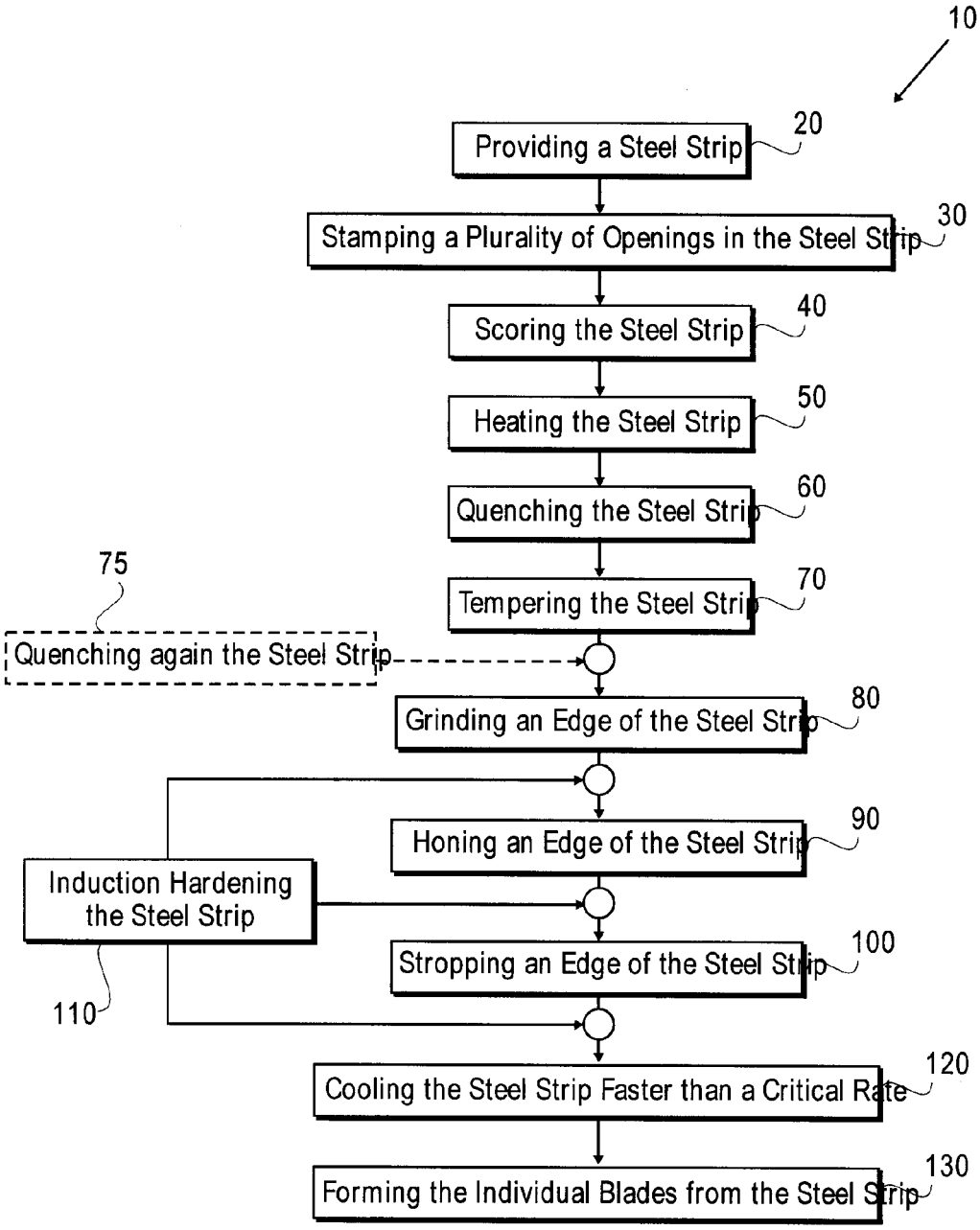
FIG. 1 is flow chart of a process of manufacturing a blade, according to an embodiment of present invention.

FIG. 1 is flow chart of a process of manufacturing a blade according to an embodiment of the present invention. In the process 10 of manufacturing a blade, a strip of steel blade stock material, from which a plurality of blades are produced, is provided at step 20. In one embodiment, the steel is provided in a coil form, for example, to render the strip more compact to facilitate handling. In an embodiment of the invention, the steel material is a high carbon steel such as, for example, steel grade C1095. The length of the strip in the coil can be as long as 1 km or more. The strip may also be provided in a multiple coils configuration, the multiple coils being welded end to end. The dimension of the strip can be selected according to desired dimensions of the blade. For example, the strip can have a width of 19 mm and a thickness of 0.6 mm. However, the strip can have other dimensions depending on the intended use of the blade that would be formed from the steel strip. In an embodiment of the invention, the steel strip is provided with a maximum hardness of about 300 HV.

Figure 2:
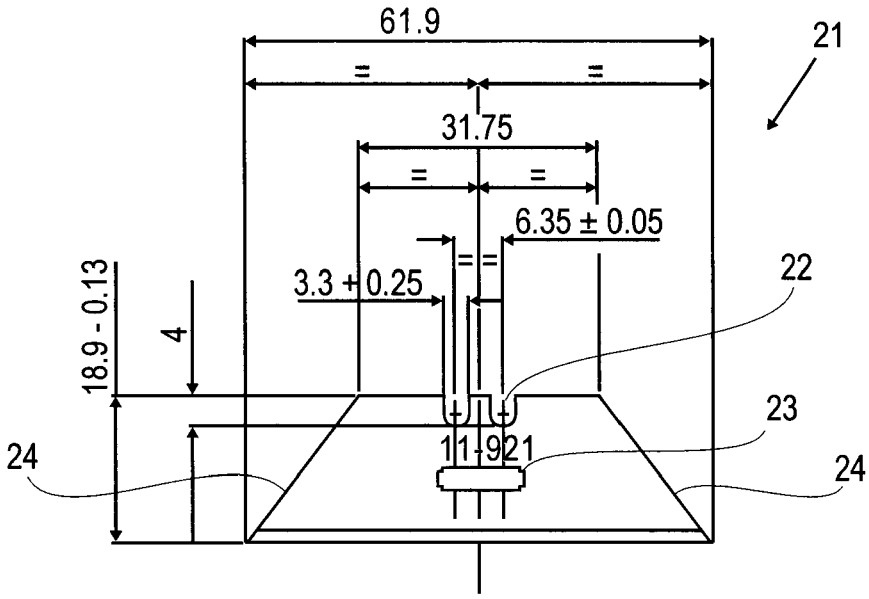
FIG. 2 shows an example of a blade according to an embodiment of the present invention.

At step 30, the steel strip material is delivered to a punch press where a plurality of openings are stamped into the strip to define attachment points employed to retain the blade in a cartridge or onto a blade carrier for utility knife. In addition, a brand name, logo or other indicia may also be stamped thereon. For example, FIG. 2 shows an example of a knife blade according to an embodiment the present invention with its various geometrical dimensions. The knife blade 21 includes openings 22 which can be employed to secure the blade 21 to utility knife blade carrier. The knife blade 21 is also shown with a stamped "STANLEY" brand name 23 on a surface of the knife blade 21.

The steel strip is then scored at step 40 to form a plurality of axially spaced score lines, wherein each score line corresponds to a side edge 24 (shown in FIG. 2) of a respective blade and defines a breaking line for later snapping or cutting the scored strip into a plurality of blades. The side edges 24 of the blade shown in FIG. 2 are configured to form a trapezoid blade. Other forms and shapes such as parallelogram blades, hook blades, etc. may also be obtained with a selection of an appropriate scoring configuration.

The coil of pressed steel strip of blade stock is then fed at step 50 through a heat treatment line to harden the steel strip material. In this process, the steel is run off of the coil and passed through a hardening furnace which heats the steel to a temperature above a transition temperature. The transition temperature is the temperature at which the structure of the steel changes from a body centred cubic structure, which is stable at room temperature, to a face centred cubic structure known as austenite (austenitic structure), which is stable at elevated temperatures, i.e. above the transition temperature. The transition temperature varies depending on the steel material used. In an embodiment of the invention, the heating to harden the steel strip is performed at a temperature between about 800° C. and 900° C. For example, for a grade C1095 steel, the transition temperature is approximately 820° C. (approximately 1508° F.). In this instance, the heating to harden the steel strip is performed at a temperature above approximately 820° C.

In an embodiment of the invention, the length of the hardening/heating furnace is approximately 26 feet (approximately 8 meters). The steel strip travels at a speed approximately between 16 and 22 feet per minute (approximately between 5 and 7 meters per minute). A controlled atmosphere of, for example, "cracked ammonia," which contains essentially nitrogen and hydrogen, is provided in the furnace to prevent oxidation and discoloration of the steel strip. Although cracked ammonia may be used to prevent oxidation and discoloration other gases may be used, such as but not limited to, "a scrubbed endothermic gas." In an embodiment of the invention, the heating of the steel strip to harden the steel strip is performed for a time period between about 75 and 105 seconds.

After exiting the heating (hardening) furnace, at step 60, the heat hardened steel strip is quenched. In an embodiment of the invention, the hardened steel strip is passed between liquid cooled conductive blocks disposed above and below the steel strip to quench the steel strip. In an embodiment of the invention, the heat hardened steel strip is passed through water-cooled brass blocks with carbide wear strips in contact with the steel strip to quench the steel. The brass blocks cool the steel strip from the hardening temperature, for example (approximately 820° C.), to ambient temperature (approximately 25° C.) at a speed above a critical rate of cooling. The critical rate of cooling is a rate at which the steel is cooled in order to ensure that the austenitic structure is transformed to martensitic structure. A martensitic structure is a body centred tetragonal structure. In the martensitic structure, the steel is highly stressed internally. This internal stress is responsible for the phenomenon known as hardening of the steel. After hardening, the hardness of the steel which was originally less than approximately 300 HV (before heat treatment) becomes approximately 850 HV (approximately 63 HRC). In an embodiment of the invention, the quenching of the steel strip is performed for about 2 to 4 seconds. In another embodiment of the invention, a gas or a liquid is used to quench the steel strip.

The steel strip is then fed, at step 70, into a tempering furnace which reduces the level of internal stress in the steel. As a result, some softening of the steel of the strip occurs with an associated increase in ductility. For example, for a grade C1095 steel, the tempering temperature is approximately 200° C. (approximately 392° F.). This tempering process reduces the hardness of the steel to within a specified range of 750 to 820 HV. In an embodiment of the invention, a length of the tempering furnace is approximately 26 feet (approximately 8 meters). The strip travels in the tempering furnace at a speed between 16 and 22 feet per minute (approximately between 5 and 7 meters per minute). A controlled atmosphere of, for example, "cracked ammonia," which contains essentially nitrogen and hydrogen and/or other gases such as "a scrubbed endothermic gas", is provided in the furnace to prevent oxidation and discoloration of the strip. After tempering the steel strip, at step 75, the steel strip may be optionally quenched again in a controlled atmosphere to prevent discoloring of steel strip by oxidation. In an embodiment of the invention, the quenching of the steel strip is performed for about 2 to 4 seconds.

With a steel hardness value of approximately 750 to 820 HV, blades which are relatively sharp and having a relatively good longevity in service can be produced. The hardness value is, however, a compromise. On one hand, a higher hardness value would result in better grinding characteristics leading to a sharper blade and a longer lifespan of the blade. However, a higher hardness value would also result in a more brittle blade. A brittle blade may be susceptible to fracture if subjected to non-axial loads (for example, pressure on flat surfaces of the blade). On the other hand, a softer blade would show improved ductility but would not perform well in service as the cutting edge would be blunted more quickly.

Therefore, the present invention provides a blade in which the body of the blade is soft enough to provide adequate ductility while providing the blade with an edge having a relatively higher hardness value to obtain better grinding characteristics of the edge. Providing an edge with a relatively higher hardness value permits a sharper edge to be ground, with increased lifespan.

Figure 3:
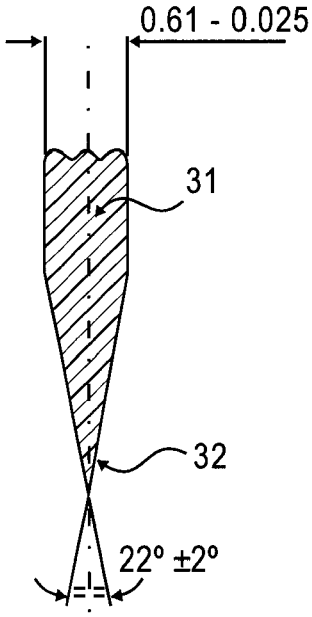
FIG. 3 shows a cross section of an example of a ground edge of a steel strip, according to an embodiment of the present invention.

In accordance with the present invention, after tempering, at step 80, the steel strip is recoiled and is transferred to a grinding machine for grinding an edge of the strip. A relatively shallow angle, such as between 10 to 32 degrees is ground onto the edge of the strip. This angle is ground on both sides of the blade, so that the blade is generally symmetrical relative to a longitudinal axis of the blade that bisects the edge, as can be appreciated from FIG. 3. In addition, the ground angle is measured relative to the longitudinal axis as can also be appreciated from FIG. 3. The angle is selected to be shallow to reduce the force that may be required to push the blade through the material it is cutting. FIG. 3 shows a cross section of an example of a ground edge of a steel strip, according to an embodiment of the present invention. In this example, the angle of the ground edge 32 of the steel strip 31 is 22°±2°.

After grinding, at step 90, the edge of the steel strip may be honed. The process of honing puts a second, less acute, angle, such as between 26 to 36 degrees, on top of the ground edge. This deeper honed angle gives a stronger edge than the more shallow ground angle and allows to extend the life span of the cutting edge. As a result the strip has an edge with a double angle.

Figure 4:
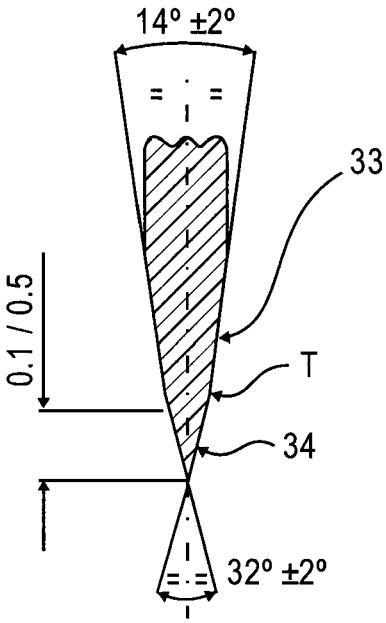
FIG. 4 shows a cross section of an example of a ground edge of steel strip with a double angle edge, according to another embodiment of the present invention.

FIG. 4 shows a cross section of another embodiment of a blade according to the invention. In this embodiment, the ground edge of a steel strip is ground so as to be provided with a double angled edge. In this example, and as illustrated in FIG. 4, a first, upper angle of the ground edge 33 of the steel strip 33 is 14°±2° and a second, lower honed angle of the edge 34 of the steel strip is 32°±2°. The transition between the first angle and the second angle is labelled by character reference "T" in FIG. 4.

Stropping the edge of the steel strip, at step 100, may be optionally added to the edge production sequence. In an embodiment of the invention, soft wheels of leather or a synthetic compound are used to remove any burrs that have been produced by the honing process. The softer the steel the more likely it is that burrs will form.

In an embodiment of the invention, the steel strip is moved at 32 feet per minute (approximately 10 meters per minute) throughout the grinding, the honing and the stropping operations. In another embodiment, the steel strip is moved at 82 feet per minute (approximately 25 meters per minute) throughout the grinding, the honing and the stropping operations.

In an embodiment of the invention, instead of producing a steel strip with an edge having a double angle, the edge of the steel strip is ground at a single angle between 10 and 32 degrees (for example, see the edge of the steel strip shown in FIG. 3). In this case, the edge of the strip may not be stropped. As stated above, the stropping process is used to remove any burrs that have been produced by the honing process. In this case, because the edge of the steel strip is ground and not honed, stropping may not be used.

In order to improve the hardness of the edge of steel strip, at step 110, a re-hardening process is applied to the edge of the steel strip. In an embodiment of the invention, an induction hardening process is applied to the edge of the steel strip. In an induction hardening process, a generator produces a high frequency alternating current at a high voltage and low current. The high frequency alternating current is passed through an inductor located in close proximity to the steel strip. The high frequency current induces heating in the steel strip. The temperature can be controlled by selection of the frequency of the current, by selection of the current intensity value, by selection of the geometry of the inductor, by varying the speed of travel of the strip relative to the inductor, and/or by selection of the position of the inductor relative to the workpiece, i.e. the steel strip. In an embodiment of the invention, the inductor is selected to be approximately 8 mm×8 mm×8 mm and the steel strip is moved at a grinding speed of 25 meters per minute. In an embodiment of the invention, the induction heating is performed by applying an induction frequency between about 26 and 30 MHz.

The induction hardening process re-heats the steel strip locally, at the cutting edge, to a temperature above the transition temperature of approximately between 800° C. and 900° C. In an embodiment of the invention, the induction hardening process re-heats the steel strip locally, at the cutting edge, to a temperature above the transition temperature of approximately 820° C. (approximately 1508° F.). The cutting edge is re-hardened by induction heating followed by rapid cooling at a rate above the critical rate at step 120 to produce a hard, fully martensitic structure along the cutting edge. A rapid cooling of the cutting edge, at a rate above the critical rate at step 120, is achieved by any or a combination of the following: conduction into the body of the blade, convection into the environment, and/or artificially accelerated cooling by an air blast or liquid quench. By rapidly cooling the cutting edge of the steel strip, a relatively hard cutting edge (for example, approximately 0.1 to 1.0 mm deep, from the tip of the edge to the body of the steel strip) is produced on a steel strip with a relatively soft body or core. Hence, the cutting edge of the steel strip is harder than the body of the steel strip.

The induction hardening of the edge of the steel strip can be carried out at any point during or after the grinding (step 80), honing (step 90) or stropping (step 100) operations, or in general before forming the individual blades, to produce a blade with an edge having improved hardness while the core or body of the blade is maintained relatively soft. The hardness of the body of the blade can be adjusted at the tempering stage (step 70), by employing different hardening temperatures, to produce softer, more ductile and safer blades with a relatively high hardness cutting edge (for example, a hardness greater than 850 HV or 66 HRC can be obtained) to facilitate smoother grinding and extended service life of the blade.

Finally, the processed steel strip is snapped along the length of the steel strip at each score line to break the steel strip along the score lines to produce a plurality of blades, at step 130. An example of an embodiment of a blade obtained according to the manufacturing process of the present invention is shown with its various dimensions in FIG. 2.

Figure 5:
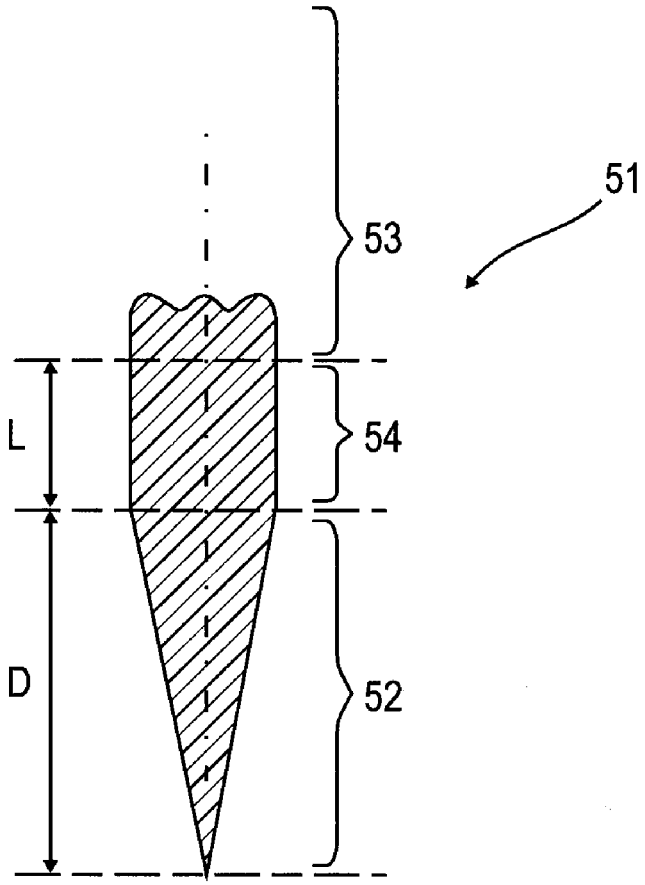
FIG. 5 shows a cross-section of a blade according to an embodiment of the present invention.

A comparative study was performed in order to compare the structures of a blade manufactured according to the process described herein and a blade manufactured according to a conventional process. FIG. 5 shows a cross-section of a blade according to an embodiment of the present invention. For comparison purposes, both the conventional blade, manufactured according to a conventional process and the blade 51 manufactured according to the process of the present invention are manufactured starting from a same bulk hardened steel strip material. The hardness of the bulk steel material is approximately 62 HRC to 64 HRC throughout a cross-section of the steel strip.

In a conventional manufacturing process, after grinding and honing, the hardness of the steel blade which was approximately 62 HRC to 64 HRC throughout a cross-section of the blade, is reduced at the cutting edge due to heating during grinding by typically 0.5 HRC to 1.0 HRC. As a result, the hardness of the blade manufactured according to a conventional process is between 62 and 63 HRC at the cutting edge and approximately 62 HRC to 64 HRC away from the cutting edge (i.e., towards the body or core of the blade). The structure of the steel of the blade is a tempered martensite throughout the blade.

For the blade 51, manufactured according to the process described herein, a re-hardening, for example, an induction hardening, of the edge 52 of the blade 51 is performed after grinding the edge 52 of the blade 51. The induction hardening process hardens the edge 52 so as to offset any loss of hardness that may have occurred during grinding of the edge 52. As a result the hardness of the blade at the cutting edge 52 is more than 64 HRC (for example, between 64 HRC and 65 HRC), i.e., greater than the hardness of the core of the blade (between 62 HRC and 64 HRC). The structure of the steel of the blade is a tempered martensite in the body of the blade 53 and fine untempered martensite at the induction hardened edge 52. In an embodiment of the invention, the induction hardening of the edge 52 of the blade 51 produces a re-hardened edge portion 52 with a depth D of approximately 0.5 mm, starting from the tip of the edge 52 towards the core of the blade 53. The depth D of the edge portion 52 can be reduced to 0.3 mm after honing. This edge portion 52 is martensitic, more specifically fine martensitic. Behind the induction hardened portion 52, there is a Heat Affected Zone (HAZ) 54 having a structure which is relatively softer compared to the induction hardened portion 52 or the core 53 of the blade 51. The HAZ 54 extends approximately a distance L of approximately 0.4 mm. In the HAZ, the hardness of the steel may drop as low as 50 HRC. The softer steel structure in the HAZ 54 is due to this zone 54 either not having been reheated to above the transition temperature or not having cooled at above the critical rate. Behind the HAZ 54 there is the remaining portion of the blade (core of the blade) 53. After reaching a minimum at the HAZ 54, the hardness increases again until reaching the hardness of the initial bulk steel material (i.e., 62 HRC to 63 HRC) at about 0.5 mm from the cutting edge 52.

Since numerous modifications and changes will readily occur to those of skill in the art, it is not desired to limit the invention to the exact construction and operation described herein. For example, while manufacturing a blade with one sharp edge is described herein, manufacturing a blade with more than one sharp edge is also contemplated. Furthermore, it must be appreciated that the process described herein is applicable to the manufacture of utility knife blades, chisel blades, plane iron blades and the like. Accordingly, all suitable modifications and equivalents should be considered as falling within the spirit and scope of the invention.

What is claimed is:

1. A method of manufacturing a utility knife blade comprising:

heating and quenching a coil of strip steel material comprising at least about 0.9% carbon to harden the strip steel material and to form a martensitic microstructure substantially throughout the coil of strip steel material;

tempering the hardened strip steel material by reheating the hardened strip steel material to form a tempered martensitic microstructure substantially throughout the coil strip steel material having a first hardness;

subsequent to tempering the hardened strip steel material, grinding a first angle along an edge of the material to form a cutting edge portion and a remaining portion; and subsequent to said grinding, re-hardening the strip steel material locally at said cutting edge portion by reheating and quenching the strip steel material locally at said cutting edge portion such that the microstructure of the strip steel material substantially throughout said cutting edge portion is untempered martensite having a second hardness that is greater than the first hardness, while the tempered martensite microstructure having the first hardness remains the microstructure substantially throughout the remaining portion.

2. The method according to claim 1, wherein said reheating of the re-hardening operation is performed at a temperature between about 800° C. and 900° C.

3. The method according to claim 2, wherein said reheating of the re-hardening operation is performed for a time period between about 75 and 105 seconds.

4. The method according to claim 1, wherein said quenching subsequent to said heating is performed for about 2 to 4 seconds.

5. The method according to claim 1, wherein said quenching subsequent to said reheating of the re-hardening is performed by passing said material between liquid cooled conductive blocks disposed above and below said material.

6. The method according to claim 5, wherein said conductive blocks comprise brass blocks.

7. The method according to claim 1, wherein said first angle is ground to approximately 10 to 32 degrees.

8. The method according to claim 7, wherein said first angle is ground to about 22 degrees.

9. The method according to claim 7, wherein said first angle is ground to about 14 degrees.

10. The method according to claim 1, wherein said reheating of the re-hardening operation is performed at a temperature between about 800° C. and 900° C.

11. The method according to claim 1, wherein said reheating of the re-hardening operation comprises induction heating the cutting edge portion of the material.

12. The method according to claim 11, wherein said induction heating is performed by applying an induction frequency between about 26 and 30 MHz.

13. The method according to claim 1, wherein said re-hardening forms a heat affected zone between the cutting edge portion and the remaining portion, the heat affected zone being softer than each of the cutting edge portion and the remaining portion.

14. The method of claim 13, wherein subsequent to the re-hardening of the cutting edge portion, the tempered martensitic steel of the remaining portion has a pliability that is greater than a pliability of the untempered martensitic steel of the cutting edge portion.

15. The method of claim 14, wherein subsequent to the re-hardening the strip steel material is less prone to breakage than a strip steel material having a substantially uniform pliability that is substantially equal to the pliability of the cutting edge portion.

16. The method according to claim 1, wherein said cutting edge portion that is re-hardened is a region of the blade between approximately 0.3 mm to 0.5 mm wide.

17. The method according to claim 1, further comprising quenching the tempered material.

18. The method according to claim 17, wherein said quenching the tempered material is performed in an atmospherically controlled environment to inhibit oxidation of said material.

19. The method according to claim 1, further comprising, honing a second angle along said cutting edge portion of the material.

20. The method according to claim 19, wherein said re-hardening is performed after said honing 21. The method according to claim 19, further comprising, after said honing, stropping said cutting edge portion of the material.

22. The method according to claim 21, wherein said re-hardening is performed after said stropping.

23. The method according to claim 19, wherein said second angle is honed to approximately between 26 to 36 degrees.

24. The method according to claim 23, wherein said second angle is honed to approximately 32 degrees.

25. The method according to claim 1, wherein quenching said cutting edge portion of the strip of steel material subsequent to reheating said cutting edge portion of the strip of steel material during the re-hardening operation comprises cooling said cutting edge portion of the material faster than a critical rate.

26. The method according to claim 25, further comprising forming individual blades from the strip steel material.

27. The method of claim 1, wherein the coil of strip steel material comprises between about 0.9% and about 1.04% carbon.

28. A method of manufacturing a utility knife blade comprising:

heating and quenching a coil of strip steel material comprising at least as much carbon as steel grade C1095 to harden the strip steel material and to form a martensitic microstructure substantially throughout the coil of strip steel material;

tempering the hardened strip steel material by reheating the hardened strip steel material to form a tempered martensitic microstructure substantially throughout the coil strip steel material having a first hardness;

subsequent to tempering the hardened strip steel material, grinding a first angle along an edge of the material to form a cutting edge portion and a remaining portion; and subsequent to said grinding, re-hardening the strip steel material locally at said cutting edge portion by reheating and quenching the strip steel material locally at said cutting edge portion such that the microstructure of the strip steel material substantially throughout said cutting edge portion is untempered martensite having a second hardness that is greater than the first hardness, while the tempered martensite microstructure having the first hardness remains the microstructure substantially throughout the remaining portion.

29. A method of manufacturing a utility knife blade comprising:

heating and quenching a coil of strip steel material to harden the strip steel material and to form a martensitic microstructure substantially throughout the coil of strip steel material;

tempering the hardened strip steel material by reheating the hardened strip steel material to form a tempered martensitic microstructure substantially throughout the coil strip steel material having a first hardness;

subsequent to tempering the hardened strip steel material, grinding a first angle along an edge of the material to form a cutting edge portion and a remaining portion; and subsequent to said grinding, re-hardening the strip steel material locally at said cutting edge portion by reheating and quenching the strip steel material locally at said cutting edge portion such that the microstructure of the strip steel material substantially throughout said cutting edge portion is untempered martensite having a second hardness that is greater than the first hardness, while the tempered martensite microstructure having the first hardness remains the microstructure substantially throughout the remaining portion.

30. The method of claim 29, wherein the coil of strip steel being heated and quenched comprises at least about 0.9% carbon.

* * * * *

UNITED STATES PATENT AND TRADEMARK OFFICE

CERTIFICATE OF CORRECTION

PATENT NO. : 8,322,253 B2
APPLICATION NO. : 11/176425
DATED : December 4, 2012
INVENTOR(S) : Haydn Howells It is certified that error appears in the above-identified patent and that said Letters Patent is hereby corrected as shown below:

On title page, item (75) Inventor
replace "Hadyn Howells"
with --Haydn Howells--.

Signed and Sealed this
Twelfth Day of February, 2013

Teresa Stanek Rea
*Acting Director of the United States Patent and Trademark Office*